US007189276B2

(12) United States Patent
Nakamura et al.

(10) Patent No.: US 7,189,276 B2
(45) Date of Patent: Mar. 13, 2007

(54) FOAMED/POROUS METAL AND METHOD OF MANUFACTURING THE SAME

(75) Inventors: Takashi Nakamura, Sendai (JP); Ryoichi Ishikawa, Wako (JP); Katsuhiro Shibata, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 337 days.

(21) Appl. No.: 10/356,494

(22) Filed: Feb. 3, 2003

(65) Prior Publication Data

US 2003/0154820 A1 Aug. 21, 2003

(30) Foreign Application Priority Data

Feb. 15, 2002 (JP) ..... 2002-039355

(51) Int. Cl.
*C22C 29/12* (2006.01)

(52) U.S. Cl. ..... 75/232

(58) Field of Classification Search ..... 420/528, 420/613

See application file for complete search history.

(56) References Cited

U.S. PATENT DOCUMENTS 3,300,296 A 1/1967 Hardy et al.
3,790,365 A * 2/1974 Niebylski et al. ..... 75/415
3,790,367 A * 2/1974 Niebylski ..... 75/415
3,981,720 A 9/1976 Speed
4,861,370 A 8/1989 Reeve-Parker
4,973,358 A * 11/1990 Jin et al. ..... 75/415
5,112,697 A * 5/1992 Jin et al. ..... 428/613
5,281,251 A * 1/1994 Kenny et al. ..... 75/415
6,171,532 B1 * 1/2001 Sterzel ..... 264/43
6,759,004 B1 * 7/2004 Dwivedi ..... 419/2

FOREIGN PATENT DOCUMENTS

JP 55-138039 10/1980
JP 2898437 3/1999

OTHER PUBLICATIONS

International Publication No. WO 92 03582 A, published Mar. 5, 1992.

* cited by examiner

*Primary Examiner*—Daniel Jenkins
(74) *Attorney, Agent, or Firm*—Arent Fox PLLC

(57) ABSTRACT

A foamed/porous metal having fine bubbles in a matrix of aluminum or magnesium has shells of aluminum oxide or magnesium oxide formed between the matrix and the bubbles of carbon dioxide.

3 Claims, 8 Drawing Sheets

(EXAMPLE 1)

(COMPARATIVE EXAMPLE 1)

FOAMED/POROUS METAL AND METHOD OF MANUFACTURING THE SAME

FIELD OF THE INVENTION

This invention relates to a foamed/porous metal having fine bubbles formed in a matrix and a method of manufacturing the same.

BACKGROUND OF THE INVENTION

There is known an art in which a foamed or porous metal is produced by adding a foaming agent to a molten or powdered metal and gasifying the foaming agent by, for example, heating to form numerous pores in the metal. In the narrow senses of the words, the foamed metal containing gas in its numerous pores differs from the porous metal emitting such gas, but since they are equal in having numerous pores, they are herein called by a combined name as a foamed/porous metal.

A method of manufacturing a foamed/porous metal is proposed in, for example, Japanese Patent No. 2,898,437 entitled "Method of Manufacturing a Foaming Metallic Body", and stating specific examples of a foaming agent, such as "0.2% by weight of titanium hydride" and "sodium hydrogen carbonate". The use of titanium hydride or sodium hydrogen carbonate containing hydrogen having a high reducing power is usual for foaming aluminum having a high affinity for oxygen. The above patent includes the statement:"A metallic body floats in water. There are formed pores distributed uniformly through the metallic body and having nearly the same size. The size of the pores is controlled by the length of time during which bubbles expand in the metal in a foaming process."

The invention according to the above U.S. Pat. No. 2,898,437 is aimed at manufacturing merely a metallic body floating in water. A recent requirement is, however, for a structural body to have a part serving both as a reinforcing member and a porous metal to realize a reduction in weight, and the prior art described above is insufficient in strength for satisfying such requirement.

SUMMARY OF THE INVENTION

It is, therefore, an object of this invention to provide an art enabling the manufacture of a foamed/porous metal of high strength.

According to this invention, there is provided a foamed/porous metal having fine bubbles in a matrix, wherein the matrix is of aluminum or magnesium, the bubbles are of carbon dioxide, and shells of aluminum oxide or magnesium oxide are present between the bubbles and the matrix.

The bubbles are formed by carbon dioxide, so that oxygen separated from carbon dioxide during the formation of bubbles may react with the matrix (aluminum or magnesium) to form shells of aluminum oxide or magnesium oxide. The shells are sufficiently hard as compared with the matrix. Therefore, the distribution of numerous rigid shells in the matrix makes it possible to obtain a foamed/porous metal of high strength.

According to this invention, there is also provided a method of manufacturing a foamed/porous metal by adding a foaming agent to a molten bath of aluminum or magnesium, wherein a powder of a carbonate compound coated with a fluoride is used as the foaming agent, so that the fluoride may destroy an oxide film covering the aluminum or magnesium and carbon dioxide produced by the carbonate compound and forming bubbles may form shells of aluminum oxide or magnesium oxide between the bubbles and the matrix.

The destruction of the oxide film covering aluminum or magnesium with a fluoride enhances the wetting of aluminum or magnesium with the foaming agent and thereby the foaming thereof. The shells of aluminum oxide or magnesium oxide formed between the bubbles and the matrix by carbon dioxide form reinforcing particles for raising the strength of a foamed/porous metal. Thus, this invention makes it possible to obtain a highly foamed/porous metal of high strength.

BRIEF DESCRIPTION OF THE DRAWINGS

Several preferred embodiments of this invention will now be described in detail with reference to the accompanying drawings, in which.

DETAILED DESCRIPTION OF THE PREFERRED EMBODIMENTS

Figure 1:
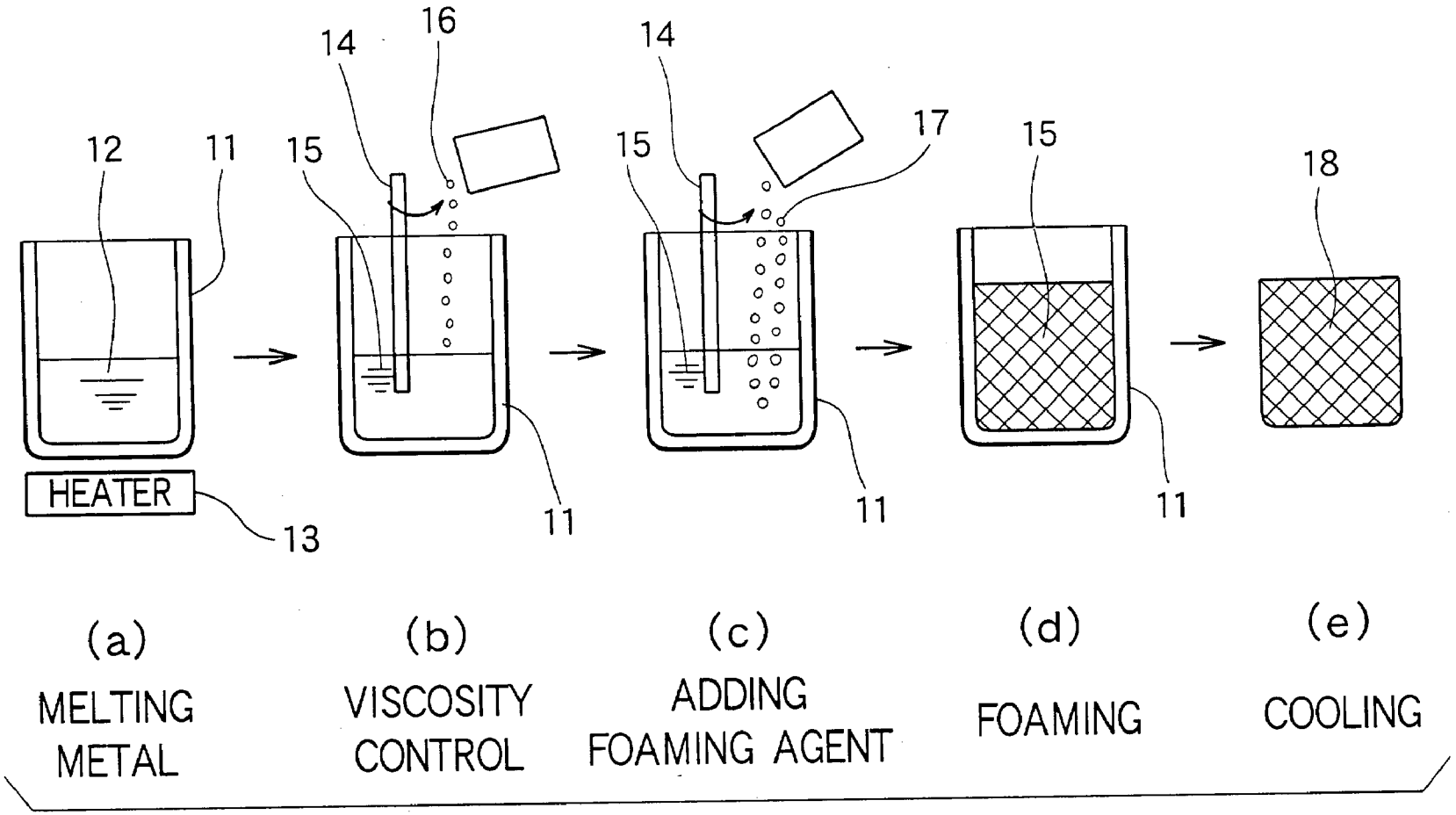
FIG. 1 is a diagrammatic illustration of a series of steps (a) to (e) for manufacturing a foamed/porous metal according to this invention.

A silicon-aluminum alloy 12 containing 7% silicon is melted in a crucible 11 by heating to about 700° C. by a heater 13, as shown at (a) in FIG. 1. If vacuum melting is employed, any such and further treatment is carried out in a vacuum furnace not shown. A viscosity controller 16, such as Ca or Mg, is added to a molten bath 15 to control its viscosity, while the molten bath 15 is stirred with a stirring device 14, as shown at (b) in FIG. 1. Then, an adequate amount of a carbonate type foaming agent 17 is added to the molten bath 15, as shown at (c) in FIG. 1. Calcium carbonate or basic magnesium carbonate is suitable as the carbonate type foaming agent 17. Basic magnesium carbonate [$4MgCO_3.Mg(OH_2).5H_2O$] will here in after be referred to as magnesium carbonate ($MgCO_3$) for the sake of convenience. The foaming agent 17 is gasified and adds to the amount of the molten bath 15, as shown at (d) in FIG. 1. Its cooling is started. It is removed from the crucible at an adequate temperature and cooled further to yield a foamed/porous metal 18, as shown at (e) in FIG. 1.

Figure 2A:
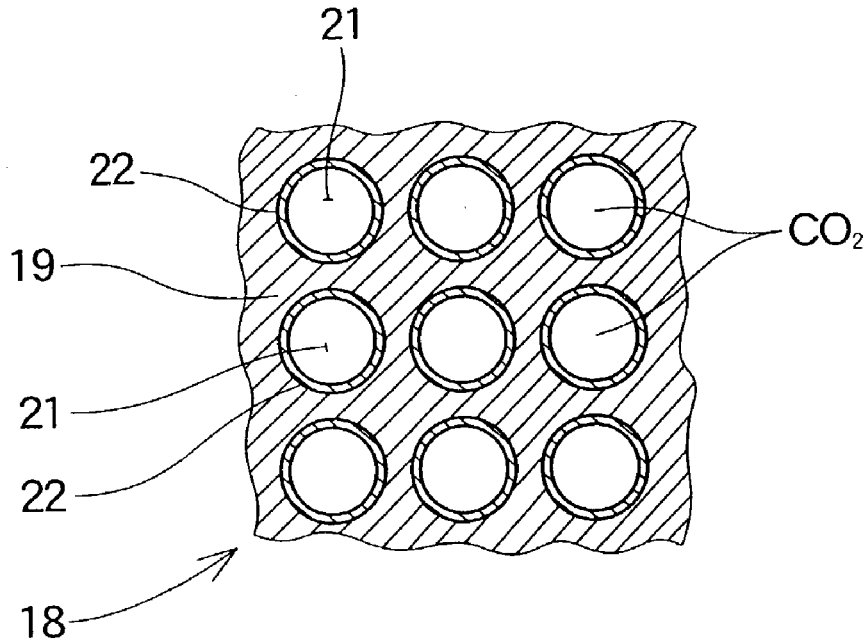
FIG. 2A is a schematic illustration of the structure of the foamed/porous metal according to Example 1 of this invention.

FIG. 2A is a diagrammatic illustration of the structure of the foamed/porous metal 18 made by the process shown in FIG. 1. It shows a matrix 19 of aluminum having numerous bubbles 21 of carbon dioxide, and a shell 22 of aluminum oxide formed between the matrix 19 and each of the bubbles 21. The formation of the shell 22 can be explained by these chemical formulas:

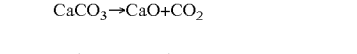

$$CaCO_3 \rightarrow CaO + CO_2$$

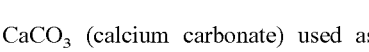

$$2Al + 2CO_2 \rightarrow Al_2O_3 + C + CO$$

$CaCO_3$ (calcium carbonate) used as the foaming agent undergoes a reaction by which it is separated into CaO and $CO_2$. This $CO_2$ reacts with the matrix (Al) to form $Al_2O_3$, C and CO, and the $A1_2O_3$ forms the shells 22.

Figure 2B:
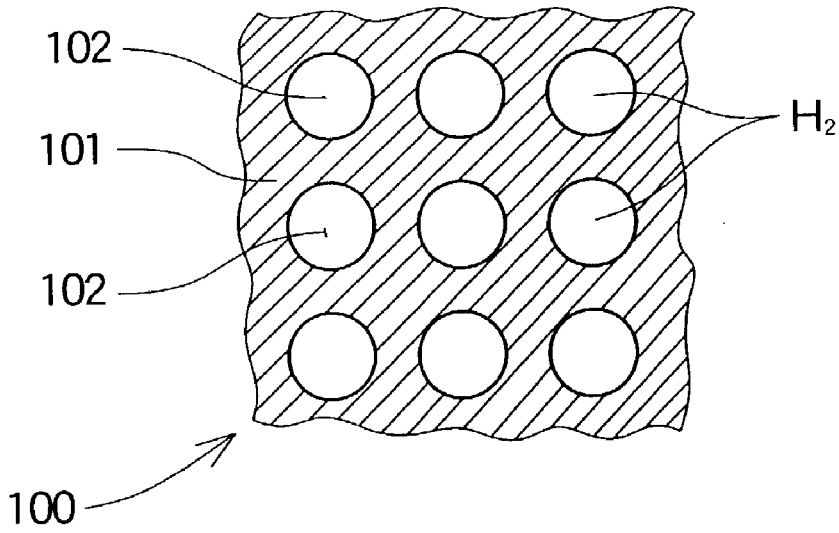
FIG. 2B is a schematic illustration of the structure of the foamed/porous metal according to Comparative Example 1.

FIG. 2B is a diagrammatic illustration of the structure of a foamed/porous metal 100 according to Comparative Example 1. Comparative Example 1 uses titanium hydride as the foaming agent, as mentioned in the statement of the prior art. Therefore, the foamed/porous metal 100 contains numerous bubbles 102 of hydrogen gas in a matrix 101 of aluminum. There is no third substance between the matrix 101 and the bubbles 102, since hydrogen does not form any compound with aluminum.

Figure 3:
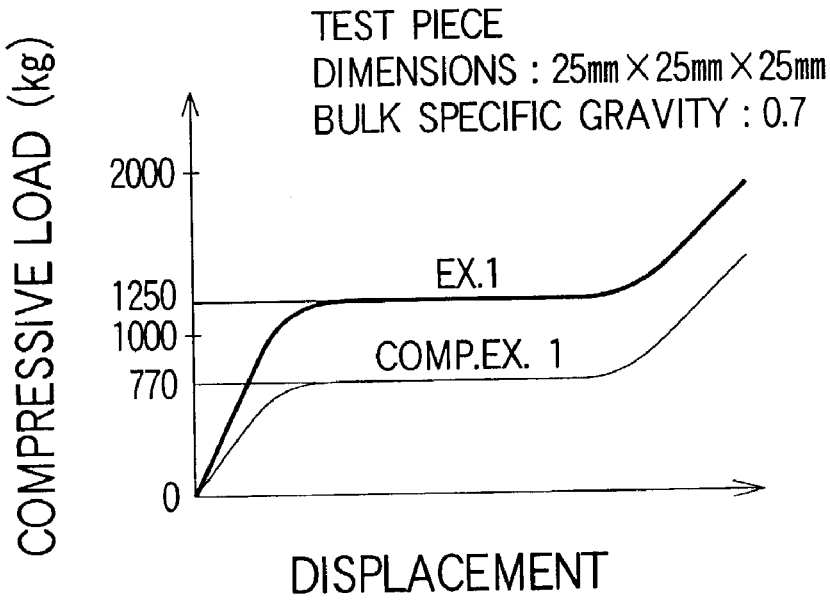
FIG. 3 is a graph showing the compressive load employed for testing the foamed/porous metals.

FIG. 3 is a graph showing the compressive load applied to the foamed/porous metals. A 25 mm cubic test piece was cut out from a foamed/porous metal having the composition shown in FIG. 2A and a bulk specific gravity of 0.7 (=0.7 g/cm$^3$), and was tested by a compressive testing machine. It showed a displacement and compressive load relation as shown by a curve including a horizontal portion corresponding to a load of 1,250 kg. Thus, the product of Example 1 was concluded as being able to withstand a compressive load of 1,250 kg. A 25 mm cubic test piece was also cut out from a foamed/porous metal having the composition shown in FIG. 2B and a bulk specific gravity of 0.7 (=0.7 g/cm$^3$), and was tested by a compressive testing machine. It showed a displacement and compressive load relation as shown by a curve including a horizontal portion corresponding to a load of 770 kg. Thus, the product of Comparative Example 1 was concluded as being able to withstand a compressive load of 770 kg.

The product according to Example 1 of this invention can be said to have a remarkably improved strength, since it showed a compressive load of 1,250 kg as compared with the compressive load of 770 kg shown by Comparative Example 1. The following is apparently the reason for the outstandingly high strength of the product according to Example 1 as compared with Comparative Example 1. The shells 22 shown in FIG. 2A are composed of $Al_2O_3$. $Al_2O_3$ is a kind of ceramics and a hard substance. It is quantitatively said to have a tensile strength of 300 to 400 N/mm$^2$ (300 to 400 MPa). On the other hand, aluminum forming the matrix has a tensile strength of 150 to 190 N/mm$^2$ (150 to 190 MPa) if it is, for example, an aluminum casting as cast. Accordingly, the shells 22 are higher in strength than the matrix surrounding them, and serve greatly as reinforcing particles for improving the strength of a metal matrix composite (MMC).

Therefore, the product according to Example 1 can be said to have a remarkably improved strength in comparison with that of Comparative Example 1.

The comparison of Example 1 and Comparative Example 1 in compressive load as described above was made by using the test pieces prepared from the foamed metals having the same bulk specific gravity. The same bulk specific gravity was employed for the comparative test. The manufacture of a large amount of foamed metals has, however, indicated that there is a difference between the bulk specific gravity (average) of foamed metals based on Example 1 and that of foamed metals based on Comparative Example 1.

Figure 4:
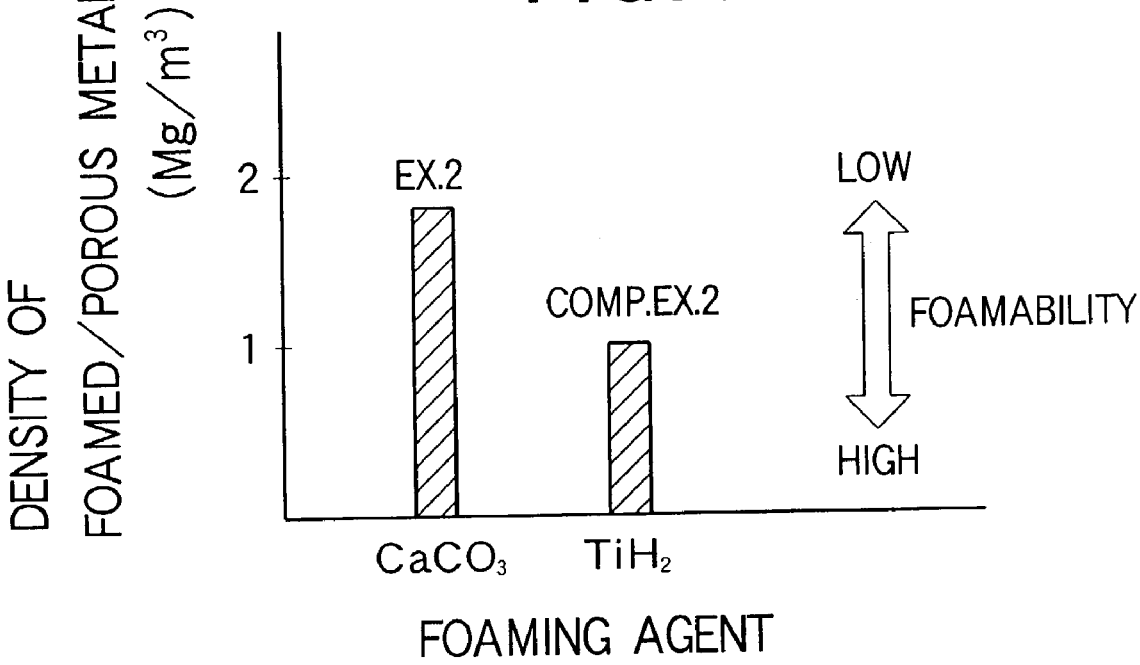
FIG. 4 is a graph showing the density of foamed/porous metals in relation to the foaming agents employed.

FIG. 4 is a graph showing the density of foamed/porous metals in relation to the foaming agents employed. Example 2 is an average of a foamed/porous metal made by using $CaCO_3$ as the foaming agent and foaming a silicon-aluminum alloy. It showed a density (average) of 1.8 Mg/m$^3$. On the other hand, Comparative Example 2 is an average of a foamed/porous metal made by using $TiH_2$ as the foaming agent and foaming a silicon-aluminum alloy. It showed a density (average) of 1.1 Mg/m$^3$.

The lower the density of a foamed/porous metal, the higher its foamability is, as shown by an arrow mark in FIG. 4. It, therefore, follows that Example 2 is inferior to Comparative Example 2 in foamability, though it is by far higher in strength. There is, however, a natural demand for a foamed/porous metal that is excellent in both strength and foamability, and we, the inventors of this invention, have conducted research to obtain a foamed/porous metal that is excellent in both strength and foamability.

We have considered that the difference in foamability is due to the strong reducing action of H (hydrogen) in $TiH_2$ for the promoted foaming of aluminum having a high affinity for oxygen, while no such action can be expected from $CaCO_3$. We have, therefore, conducted research work for adding to $CaCO_3$ an action similar to the reducing action of H (hydrogen) without using any hydrogen, and succeeded in establishing the necessary art. The following is the history of our work.

Figure 5:
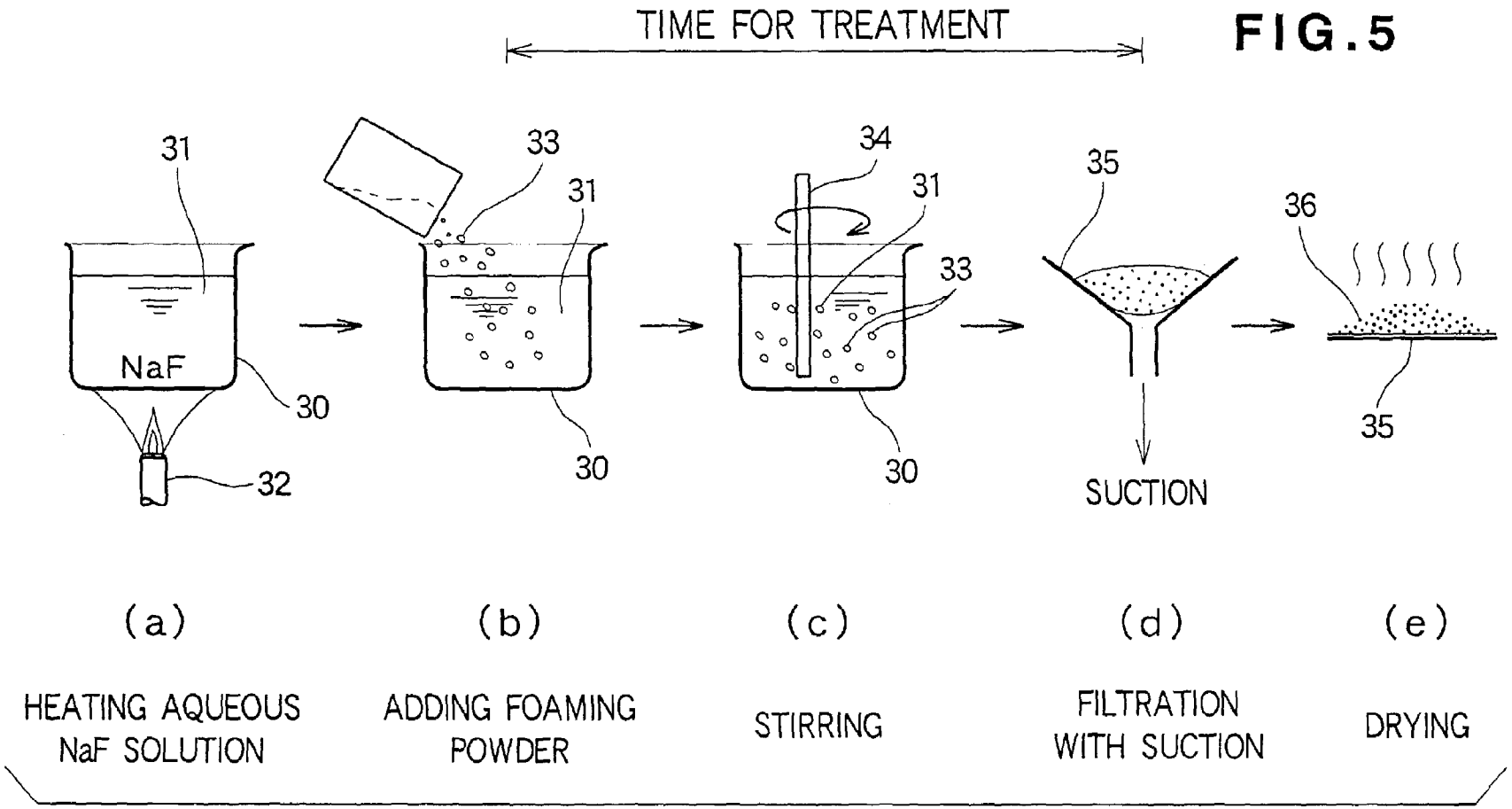
FIG. 5 is a diagrammatic illustration of a series of steps (a) to (e) for preparing a foaming agent according to this invention by coprecipitation.

Description will first be made of a coprecipitation process for preparing a foaming agent according to this invention. FIG. 5 is an illustration of steps (a) to (e) for the coprecipitation process.

(a) An aqueous solution of NaF 31 in a container 30 is heated to about 40° C. by a heater 32.

(b) A foaming powder 33 is put in the aqueous solution of NaF 31. The foaming powder 33 is of a carbonate compound, such as calcium carbonate ($CaCO_3$) or magnesium carbonate ($MgCO_3$). It is used since it produces carbon dioxide having no danger of explosion, and since it contributes to making a porous metal of improved strength as stated before.

(c) The aqueous solution of NaF 31 and the foaming powder 33 are thoroughly stirred by a stirrer 34. Their stirring causes the following reaction. The stirring is continued for 40 to 45 minutes for the reason that will be explained later.

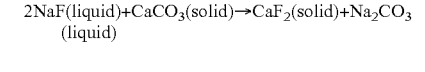

$$2NaF(\text{liquid}) + CaCO_3(\text{solid}) \rightarrow CaF_2(\text{solid}) + Na_2CO_3(\text{liquid})$$

The liquid is an aqueous solution, and the solid is a powder or film. If a powder of $CaCO_3$ is brought into contact with an aqueous solution of NaF, Ca and F combine to form $CaF_2$, while the remainder forms $Na_2CO_3$ (liquid) mixed in the aqueous solution of NaF. More specifically, $CaCO_3$ on the surface of the powder of $CaCO_3$ has $CO_3$ replaced by F upon contacting NaF to form the fluoride, $CaF_2$, covering the powder of $CaCO_3$.

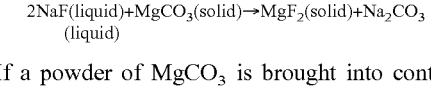

$$2NaF(\text{liquid}) + MgCO_3(\text{solid}) \rightarrow MgF_2(\text{solid}) + Na_2CO_3(\text{liquid})$$

If a powder of $MgCO_3$ is brought into contact with an aqueous solution of NaF, $MgCO_3$ on the surface of the powder of $MgCO_3$ has $CO_3$ replaced by F upon contacting NaF to form the fluoride, $MgF_2$, covering the powder of $MgCO_3$.

(d) The mixed solution is filtered through a filtering material 35, such as filter paper. Suction promotes filtration.

(e) A desired foaming agent 36 is obtained by drying.

Figure 6:
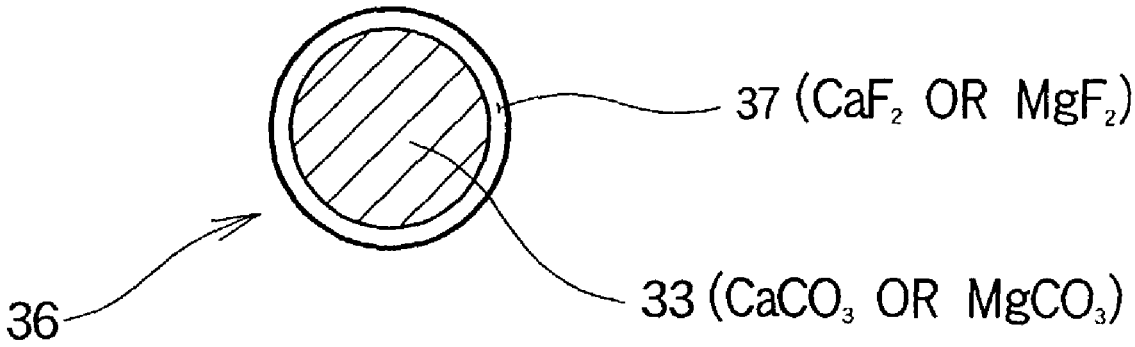
FIG. 6 is a diagrammatic illustration of a particle of the foaming agent according to this invention.

FIG. 6 is a diagrammatic illustration of a particle of the foaming agent according to this invention. Each particle of the foaming agent 36 is composed of a particle of the foaming powder 33 of a carbonate compound (powder of $CaCO_3$ or $MgCO_3$), and a fluoride coating layer 37 covering the surface of the particle of the foaming powder 33. The fluoride coating layer 37 is, for example, of $CaF_2$ or $MgF_2$.

Figure 7:
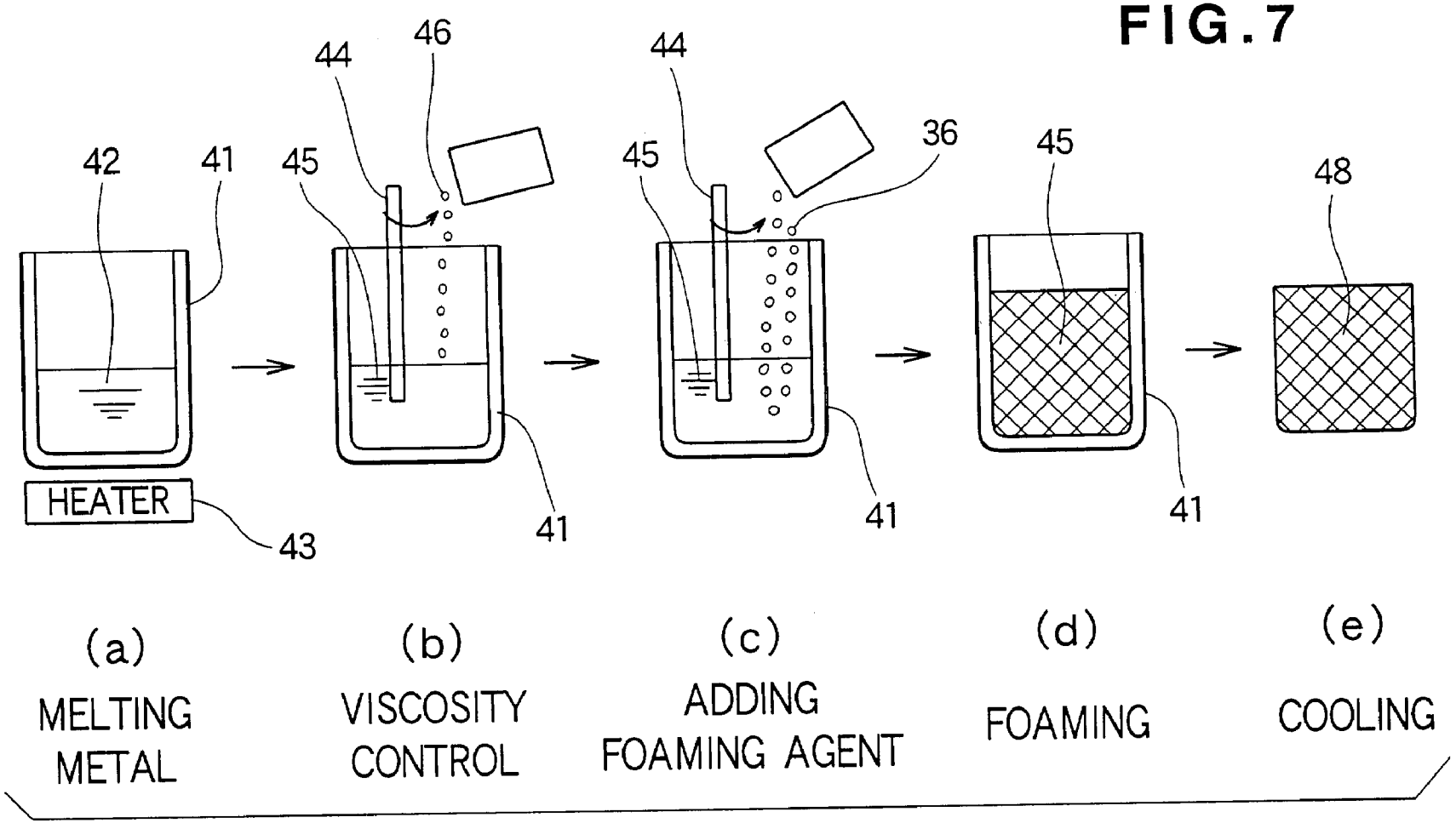
FIG. 7 is a diagrammatic illustration of a series of steps (a) to (e) for manufacturing a foamed/porous metal by using the foaming agent according to this invention.

Attention is now directed to FIG. 7 showing a process for manufacturing a foamed/porous metal by using the foaming agent 36 as described. It is substantially identical to FIG. 1, but as it employs a different foaming agent, the process will now be described again.

(a) A silicon-aluminum alloy 12 containing 7% silicon is melted in a crucible 41 by heating to about 700° C. by a heater 43. If vacuummelting is employed, any such and further treatment is carried out in a vacuum furnace not shown.

(b) A viscosity controller 46, such as Ca or Mg, is added to a molten bath 45 to control its viscosity, while the molten bath 45 is stirred with a stirring device 44.

(c) An adequate amount of a carbonate type foaming agent 36 coated with a fluoride is added to the molten bath 45.

(d) The foaming agent 36 is gasified and adds to the amount of the molten bath 45. Its cooling is started.

(e) It is removed from the crucible at an adequate temperature and cooled further to yield a foamed/porous metal 48.

Figure 8:
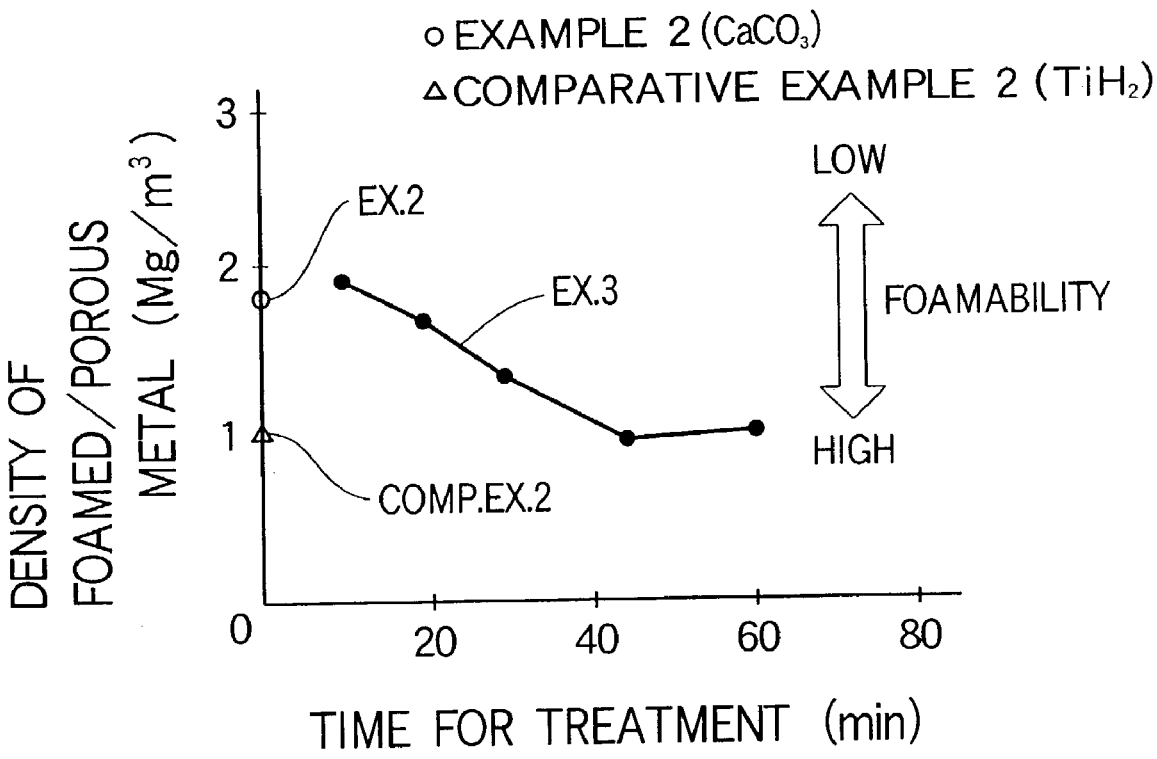
FIG. 8 is a graph showing the density of foamed/porous metals in relation to the length of time for treatment.

FIG. 8 is a graph showing the density of foamed/porous metals in relation to the length of time for treatment. The length of time for treatment as plotted along the x-axis is the time employed for the steps (b) to (d) in FIG. 7, or the time for which the foaming powder remains in contact with the aqueous solution of NaF. Example 2 shown by a circle on the y-axis in FIG. 8 and Comparative Example 2 shown by a triangle have already been described with reference to FIG. 4. The foamed/porous metal according to Example 2 was made by foaming a silicon-aluminum alloy with $CaCO_3$ and had a density of 1.8 $Mg/m^3$, while the foamed/porous metal according to Comparative Example 2 was made by foaming a silicon-aluminum alloy with $TiH_2$ and had a density of 1.1 $Mg/m^3$, as already stated.

On the other hand, Example 3 of this invention teaches that the foamability of a metal depends largely on the length of time for treatment as shown along the x-axis. More specifically, a period of time for treatment not exceeding 10 min. gives the results not differing from those of Example 2, but a period prolonged to 40 min. or more gives the foamability that is comparable to that of Comparative Example 2. Thus, a period of, say, 40 to 60 min. may be suitable for treatment.

As is obvious from the graph, however, the density achieved by Example 3, which was the lowest at about 43 min., showed at 60 min. a rise that was undesirable from a foamability standpoint. Moreover, spending 60 min. for treatment brings about a reduction in productivity. Therefore, a period of 40 to 45 min. is recommended as the time for treatment satisfying the requirements for both the proper length of time for treatment and the low density of the product.

The proper elongation of time for treatment enables the fluoride coating layer 37 as shown in FIG. 6 to grow satisfactorily and increase in thickness. Its increase in thickness brings about a proportional increase in the amount of the fluoride that the foaming agent contains, and as the fluoride actively destroys the oxide film on the surface of the aluminum alloy, it is possible to obtain the results that are comparable to those of Comparative Example 2.

According to an important feature of this invention, the foaming agent is inexpensive and free from any danger of hydrogen explosion, since it is composed of a foaming powder of a carbonate compound (powder of $CaCO_3$ or $MgCO_3$) and fluoride coating layers covering the surfaces of the particles of the foaming powder.

Figure 9:
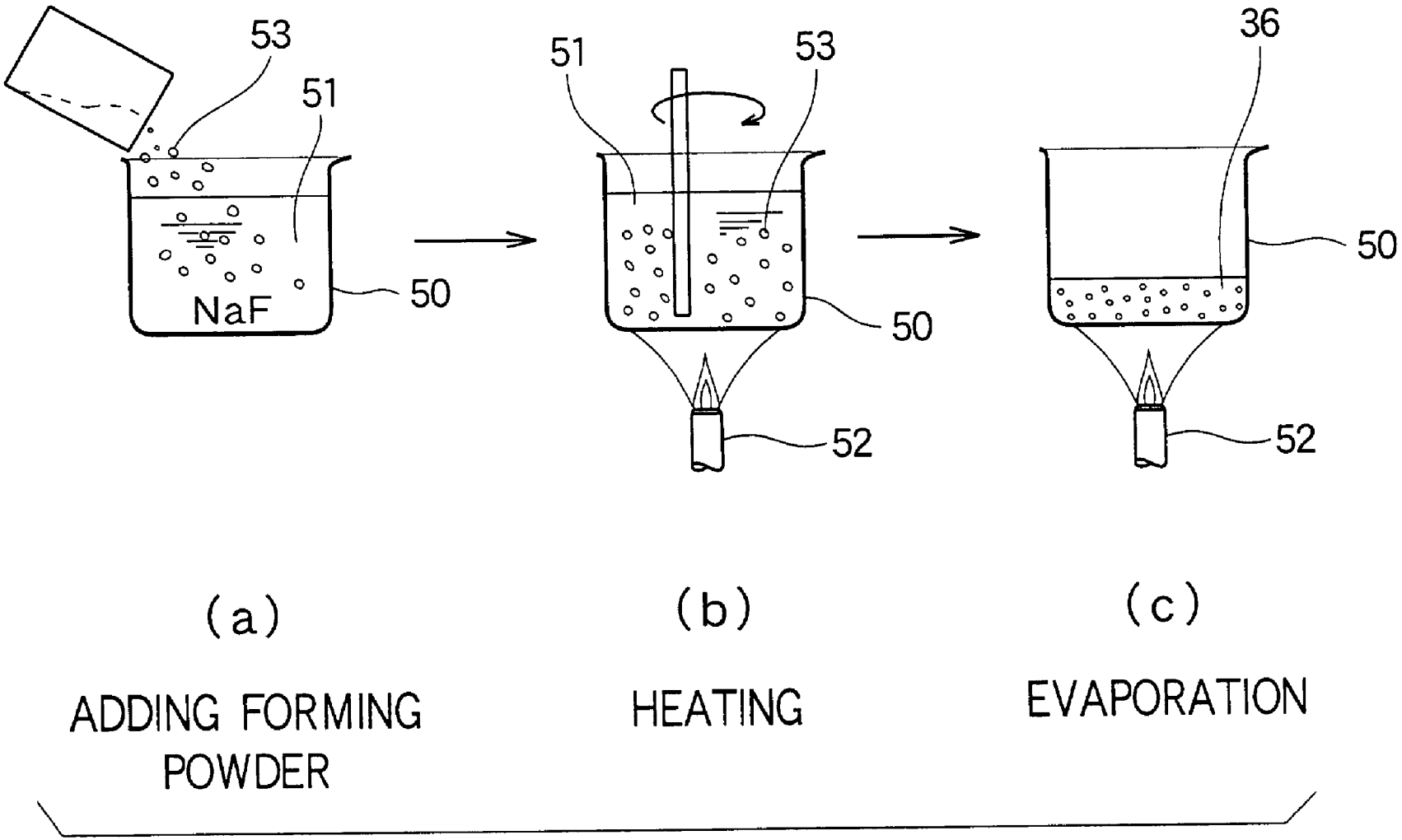
FIG. 9 is a diagrammatic illustration of a series of steps (a) to (c) for the evaporation of the foaming agent according to this invention.

The foaming agent according to this invention can be prepared not only by the coprecipitation process as described with reference to FIG. 5, but also by an evaporation process as will now be described. FIG. 9 shows an evaporation process having steps (a) to (c) for preparing the foaming agent according to this invention.

(a) A foaming powder 53 is put in an aqueous solution of NaF 51 in a container 50.

(b) The aqueous solution of NaF51 and the foaming powder 53 are stirred together, while being heated by a heater 52. Their stirring causes the following reactions:

$$2NaF(\text{liquid})+CaCO_3(\text{solid})\rightarrow CaF_2(\text{solid})+Na_2CO_3(\text{liquid})$$

$$2NaF(\text{liquid})+MgCO_3(\text{solid})\rightarrow MgF_2(\text{solid})+Na_2CO_3(\text{liquid})$$

The details of the reactions have been described before and their description is not repeated.

(c) The heating of the container 50 by the heater 52 is continued to evaporate water to thereby produce a foaming agent 36. The cross sectional structure of each particle of the foaming agent 36 has been described with reference to FIG. 6.

As regards the fluoride, any other compound containing a fluorine group can also be employed.

According to this invention, the bubbles are formed by carbon dioxide, so that oxygen separated from carbon dioxide during the formation of bubbles may react with the matrix (aluminum or magnesium) to form the shells of aluminum oxide or magnesium oxide, as described above. The shells are sufficiently hard as compared with the matrix. Thus, the distribution of numerous rigid shells in the matrix makes it possible to obtain a foamed/porous metal of high strength.

According to another feature of this invention, the fluoride destroys the oxide film covering aluminum or magnesium to improve the wetting of the metal with the foaming agent and thereby its foamability. The shells of aluminum oxide or magnesiumoxide formed between the matrix and the bubbles by carbon dioxide serve as reinforcing particles for raising the strength of the foamed/porous metal. Therefore, this invention makes it possible to obtain a highly foamed/porous metal of high strength.

The present disclosure relates to the subject matter of Japanese Patent Application No. 2002-039355, filed Feb. 15, 2002, the disclosure of which is incorporated herein by reference in its entirety.

What is claimed is:

1. A foamed/porous metal having fine bubbles in a metal matrix, wherein the bubbles are of carbon dioxide, and shells of metal oxide are present between the bubbles and the matrix, the foamed/porous metal manufactured by adding a foaming agent to a molten bath of a metal forming a matrix, wherein a powder of a carbonate compound coated with a fluoride is used as the foaming agent, so that the fluoride may destroy an oxide film covering the matrix metal and carbon dioxide produced by the carbonate compound and forming bubbles form shells of metal oxide between the bubbles and the matrix.

2. The foamed/porous metal according to claim 1, wherein the matrix is of aluminum and the metal oxide is aluminum oxide.

3. The foamed/porous metal according to claim 1, wherein the matrix is of magnesium and the metal oxide is magnesium oxide.

* * * * *